US006019221A

United States Patent [19]

Benja-Athon

[11] Patent Number: 6,019,221

[45] Date of Patent: Feb. 1, 2000

[54] ELECTRIC-AND-MAGNETIC PHOTOGRAPHIC IMAGE STORAGE CARTRIDGE AND CANISTER HOLDER

[76] Inventor: Anuthep Benja-Athon, 210 E. 36th St., Ground Floor, New York, N.Y. 10016

[21] Appl. No.: 09/277,121

[22] Filed: Mar. 26, 1999

[51] Int. Cl.[7] ..... B65D 85/00

[52] U.S. Cl. ..... 206/455; 206/499

[58] Field of Search ..... 206/455, 389, 206/391, 499, 814, 594, 578, 454

[56] References Cited

U.S. PATENT DOCUMENTS 5,462,167 10/1995 Polinski et al. ..... 206/455
5,600,394 2/1997 DeCook et al. ..... 206/455 X

*Primary Examiner*—Jacob K. Ackun

[57] ABSTRACT

An electric-and-magnetic-insulating plastic container storage box to store and protect electronic and magnetic photographic image storage cartridges and cartridge canisters comprises a rectangular box having a fitting electric-and-magnetcinsulating closing lid member having two hinges whereby the lid can reversibly close the box rendering the interior of the box void of electromagnetics wherein fitted an electrostatic-inert, flat holding panel comprises a first electrostatic-inert, rectangular front plastic sheet member comprises individual elliptical-cross-sectional bores to fit, receive and sequester half a length portion of each cartridge and canister therein for receiving and storing individual the cartridges and canisters united by four cylindrical pegs to a similarly-dimensioned second electrostatic-inert, rectangular rigid back plastic sheet member at four corners of both sheet members adaptable to bond by adhesive glue to the bottom wall of the box to store and protect the cartridges and canisters from misplacement, dust and exposure to damaging electromagnetics. Alternatively, rectangular solid block comprises individual elliptical-cross-sectional bores being carved into the block is used in place of the panel.

9 Claims, 1 Drawing Sheet

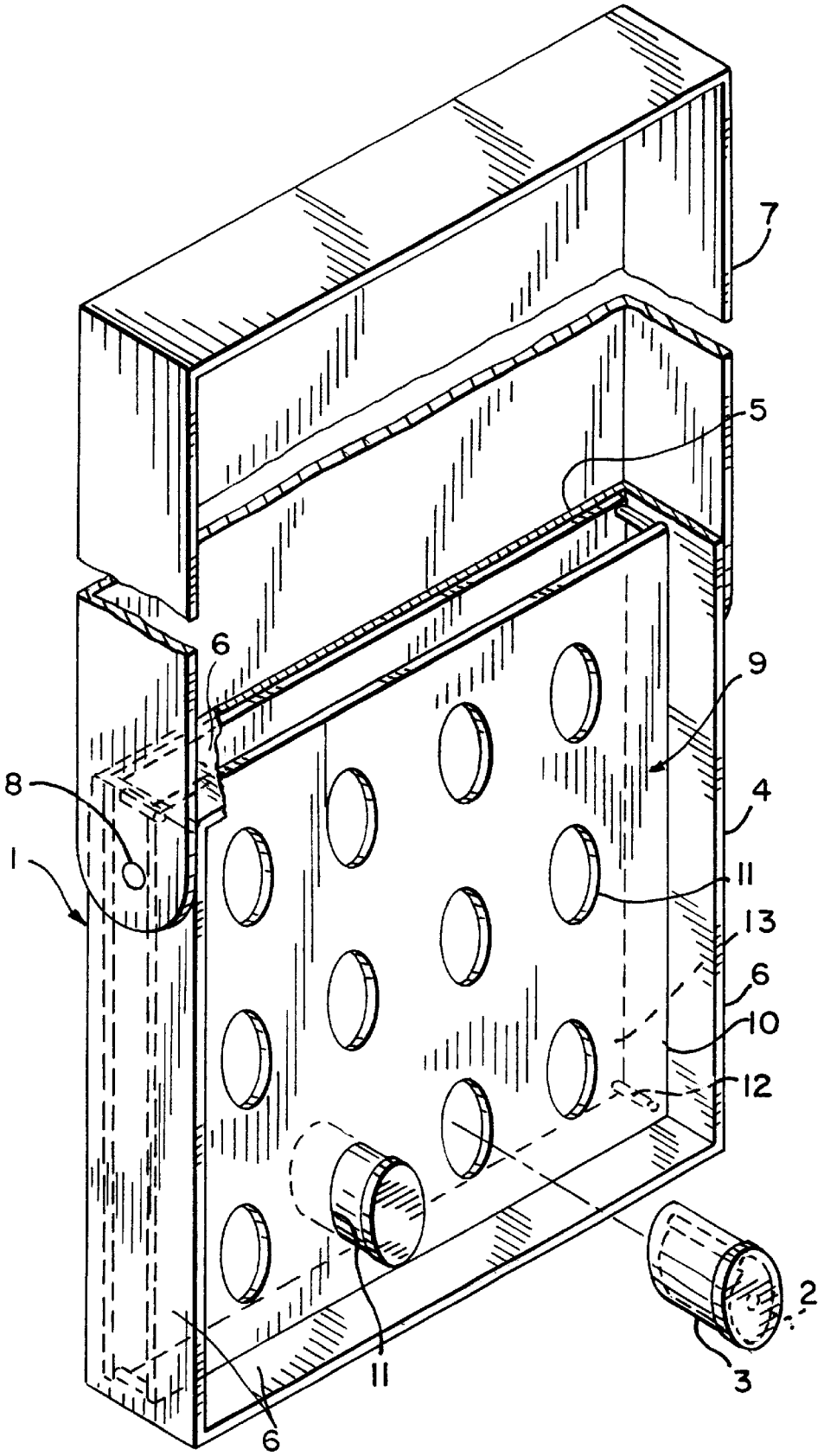
7
5
6
9
8
4
1
11
13
6
10
12
2
3
11
6

ELECTRIC-AND-MAGNETIC PHOTOGRAPHIC IMAGE STORAGE CARTRIDGE AND CANISTER HOLDER

FIELD OF INVENTION

An electric-and-magnetic-proof, storage box for storage and protection of electromagnetic photographic image storage cartridge and canister.

BACKGROUND OF THE INVENTION

The present invention provides a protective and storage box of electromagnetic photographic image storage cartridge and canister to prevent damage from natural elements such as water, dust and electromagnetics and misplacement.

The most common available silver-based photographic films are processed as strips of film, the so-called negatives, which can be easily stored like pages of a book. However, with the advance in the technology of electromagnetic imaging devices, many types of modern cameras now take photographic images which are stored as electronic, electromagnetic or magnetic signals. Said signals can be used to produce pictures on paper and also can be stored in computer diskettes and computerized signal storage devices. Said cameras use photographic image storage cartridge or cassette which stores the images as electromagnetic and magnetic signal not unlike computer and said silver-based photographic film is totally eliminated. Said cartridge or cassette is stored during the transportation and marketing processes in plastic cartridge canister of similar contour and about the same dimensions. Said cartridge and canister need to be organized, cataloged, stored and protected from damaging natural elements such as loss water, dust, electromagnetics such as but not limited to magnets and any household appliances which emit electromagnets.

The prevent invention achieves the above objectives.

SUMMARY OF THE INVENTION

Modern cameras now take photographic images which are stored as electronic, electromagnetic or magnetic signals in cartridge or cassette. There is a need for an apparatus to organize, catalog, store and protect said device from damaging natural elements such as loss water, dust, electromagnetics such as but not limited to magnets and any household appliances which emit electromagnets.

The present invention provides an apparatus of an electric-and-magnetic-insulating plastic container storage box to store and protect electronic and magnetic photographic image storage cartridges and cartridge canisters comprises a rectangular box having a fitting electric-and-magnetic-insulating closing lid member having two hinges whereby the lid can reversibly close the box rendering the interior of the box void of electromagnetics wherein fitted an electrostatic-inert, flat holding panel comprises a first electrostatic-inert, rectangular front plastic sheet member comprises individual elliptical-cross-sectional bores to fit, receive and sequester half a length portion of each cartridge and canister therein for receiving and storing individual the cartridges and canisters united by four cylindrical pegs to a similarly-dimensioned second electrostatic-inert, rectangular rigid back plastic sheet member at four corners of both sheet members adaptable to bond by adhesive glue to the bottom wall of the box to store and protect the cartridges and canisters from misplacement, dust and exposure to damaging electromagnetics. Alternatively, rectangular solid block comprises individual elliptical-cross-sectional bores being carved into the block is used in place of the panel.

BRIEF DESCRIPTION OF THE DRAWING

The drawing is a schematic of the present invention.

DESCRIPTION OF THE PREFERRED EMBODIMENTS

The drawing shows the electric-and-magnetic-insulating container storage box 1 means of protecting and storing individual electronic and magnetic photographic image storage cartridges or cassettes 2 and cartridge (or cassette) canisters 3. Box 1 comprises a rectangular box 4 comprises a bottom wall 5 and four side walls as represent by 6 to define box 1. Attached to two side walls of box 1 is a fitting electric-and-magnetic-insulating closing lid member 7 by two hinges as represent by 8 to couple lid 7 to two side wall members of box 1 whereby lid 7 can be moved about a single pivot axis through said hinges 8 to reversibly close box 1 rendering the interior of said box void of electromagnetics. An electrostatic-inert, flat holding panel 9 comprises a first electrostatic-inert, rectangular front plastic sheet member 10 comprises individual elliptical-cross-sectional bore 11 means of fitting, receiving and sequestering half a length portion of said cartridges and canisters. Four cylindrical pegs or the like as represent by 12 unite a similarly-dimensioned second electrostatic-inert, rectangular rigid back plastic sheet member 13 at four corners of both sheet members to form panel 9. The inner wall of each elliptical-cross-sectional bore 11 adaptable to fit, receive and store either cartridge 2 or canister 3 by being either resilient or manufactured to be slightly smaller than the cross-sectional dimension of either cartridge 2 or canister 3, i.e. less than a millimeter. Each bore 11 has about 0.75–0.875 inch× 1.125–1.25 inch in elliptical cross-sectional dimension and about half the length portion of cartridge 2 and canister 3. Sheet member 13 adaptable to bond said panel by adhesive glue means to bottom wall 5 of box 1.

Box 1 is shown in the drawings to store a plurality of 12 cartridges 2 or canisters 3 and will have a depth of 2.5 inches. However, efficiently, box 1 can certainly be designed and manufactured to store more than 12 cartridges 2 or canisters 3 since the dimension of each cartridge 2 or canister 3 is only 0.75–0.875 inch×1.125–1.25 inch as stated supra.

Alternatively, a solid block or bubbled block henceforth also 9, not shown in the figure can be used in place of said panels in box 1. The use of said blocks is far easier to manufactured and installed into box 1. Bores 11 can be carved or molded into the block during manufacturing process.

Each bore 11 can be replaced by four-knuckle-like grip device which individual grip a portion of cartridge 2 or canister 3 and hold cartridge 2 or canister 3 in a fix position on panel or block 9. Of course, other means of fitting, holding, fixing cartridge 2 or canister 3 can be used without departing from the spirit of the invention or the scope of the claims.

Box 1, lid 7, panel and blocks 9, also referred infra as the apparatus, are manufactured from plastic material incorporating electric-and-magnetic-insulating and electrostatic inert substances to render the inside of box 1, lid 7, panel and blocks 9 all void of electromagnetic and electrostatic interferences. Alternatively, box 1 and lid 7 are manufactured from plastic material and covered with layers of electric-and-magnetic-insulating substances to render the inside of said box void of electromagnetics during the fabrication process. Other synthetic materials including wood, styrofoam and sponge can also be used.

Box 1 can then be stacked one on top of the other in a drawer or on a shelf. Alternatively, box 1 can be mounted to a wall in the closet or cabinet like an electrical fuse box as per routine wall mounting using screws, nails, etc. Of course, bottom wall 5 will be made with holes which can be used to tread said screws and nails.

To reduce the cost of manufacturing and make the apparatus more readily available to consumers, ordinary plastic container storage box 1, lid 7, panel and blocks 9 can be made without the luxury of the electric-and-magnetic-insulating and electrostatic inert substances as long as the device is mounted or store in area devoid of damaging electromagnetics. Of course, panel or block 9 will be made with holes which can be used to tread said screws and nails for said mounting.

Furthermore, to reduce the cost of manufacturing and make the apparatus even more readily available to consumers, panel and blocks 9 can be made and/or used without the luxury of box 1 without or without the electric-and-magnetic-insulating and electrostatic inert substances as long as the device is mounted or store in area devoid of damaging electromagnetics. In other words, box 1 and panel or block 9 can be made but panel or block 9 is available and can be used without box 1. Panel or block 9 can then be stacked one on top of the other like a eggcrates. Alternatively, panel or block 9 can be mounted to a wall in the closet or cabinet as per routine wall mounting using screws, nails, etc.

On the front surface of lid 7, a written list and catalog of the stored cartridges 2 or canisters 3 can be made to correspond to the numbering in numerical order on panel or block 9 to track each serial number on stored cartridges 2 or canisters 3 and photographic panel of pictures, not shown in the drawing. Similarly, on the front surface of lid 7 and panel or block 9, not shown in the drawing, tactile inscription, such as but not limited to Braille depicting said list, catalog and numbers of the stored cartridges 2 or canisters 3 for nonsighted or visually impaired persons are done.

The electric-and-magnetic-insulating and inert properties of the box, lid and various component parts of the invention are to protect the integrity of the images stored as electric and magnetic code within said cartridge. Of course, other configuration and various dimensions of the box, lid, panel and bore can be varied to be such as, but not limited to, can be circular, square, four-knuckle-like grip without departing from the spirit of the invention or the scope of the claims.

Although various preferred embodiments of this invention have been described, it will be appreciated by those skilled in the art that adaptations and variations may be made without departing from the spirit of the invention or the scope of the claims.

I claim:

1. An electric-and-magnetic-insulating container storage box means of protecting and storing individual electronic and magnetic photographic image storage cartridges and cartridge canisters comprising a rectangular box having a fitting electric-and-magnetic-insulating closing lid member having two hinges to couple said lid to two side wall members of said box whereby said lid can be moved about a single pivot axis through said hinges to reversibly close said box rendering the interior of said box void of electromagnetics wherein fitted an electrostatic-inert, flat holding panel comprises a first electrostatic-inert, rectangular front plastic sheet member comprises individual elliptical-cross-sectional bore means of fitting, receiving and sequestering half a length portion of said cartridges and canisters therein for receiving and storing individual said cartridges united by four cylindrical pegs to a similarly-dimensioned second electrostatic-inert, rectangular rigid back plastic sheet member at four comers of both sheet members adaptable to bond said panel by adhesive glue means to said box to store and protect said cartridges and canisters from misplacement, dust and exposure to damaging electromagnetics.

2. The storage box according to claim 1 comprises a bottom wall adaptable to bond by means of adhesive glue with said second back rigid sheet of said panel, four side walls defining said box, and said fitting electromagnetic-insulating closing lid having two hinges to couple said lid to two side wall members of said box whereby said lid can be moved about a single pivot axis through said hinges to reversibly close said box.

3. The storage box and lid according to claim 2 are manufactured from plastic material incorporating electric-and-magnetic-insulating substances to render the inside of said box void of electromagnetics during the manufacturing process.

4. The storage box and lid according to claim 2 are manufactured from plastic material and covered with layers of electric-and-magnetic-insulating substances to render the inside of said box void of electromagnetics during the fabrication process.

5. The storage box according to claim 1 wherein said first electrostatic-inert, rectangular front plastic sheet member comprises individual elliptical-cross-sectional bore held parallelly aligned to a similarly-dimensioned second electrostatic-inert, rectangular back plastic sheet member both of which are united by four cylindrical pegs at all four comers of said sheets whose length and width dimension permit said holding panel to tightly fit into said box and the depth of the entire holding panel is half the length of said cartridge and canister.

6. The flat holding panel according to claim 5 comprises a first rigid plastic sheet member having a plurality of bore each of which has a 0.75–0.875 inch×1.125–1.25 inch elliptical cross-section which fits, receives and reversibly sequesters half the length portion of said cartridge and canister.

7. The flat holding panel according to claim 5 is permanently mounted into said box using adhesive glue which permanently bonds said second sheet member to the bottom wall of said box.

8. An electric-and-magnetic-insulating container storage box means of protecting and storing individual electronic and magnetic photographic image storage cartridges and cartridge canisters comprising a rectangular box having a fitting electric-and-magnetic-insulating closing lid member having two hinges to couple said lid to two side wall members of said box whereby said lid can be moved about a single pivot axis through said hinges to reversibly close said box rendering the interior of said box void of electromagnetics wherein fitted an electrostatic-inert, rectangular solid block comprises individual elliptical-cross-sectional bores being carved into said block during manufacturing process adaptable to fit, receive and sequester half a length portion of said cartridges and canisters to store and protect said cartridges and canisters from misplacement, dust and exposure to damaging electromagnetics.

9. A plastic container storage box means of protecting and storing individual electronic and magnetic photographic image storage cartridges and cartridge canisters comprising a rectangular box having a fitting plastic closing lid member having two hinges to couple said lid to two side wall members of said box whereby said lid can be moved about a single pivot axis through said hinges to reversibly close said box wherein fitted a rectangular solid block comprises individual elliptical-cross-sectional bores being carved into said block during manufacturing process adaptable to fit, receive and sequester half a length portion of said cartridges and canisters to store and protect said cartridges and canisters from misplacement, dust and exposure to damaging electromagnetics.

* * * * *